US010010736B2

(12) United States Patent
Chen

(10) Patent No.: US 10,010,736 B2
(45) Date of Patent: Jul. 3, 2018

(54) TRAMPOLINE FRAME JOINT

(71) Applicant: Samuel Chen, Hong Kong (CN)

(72) Inventor: Samuel Chen, Hong Kong (CN)

( * ) Notice: Subject to any disclaimer, the term of this patent is extended or adjusted under 35 U.S.C. 154(b) by 0 days.

(21) Appl. No.: 15/491,235

(22) Filed: Apr. 19, 2017

(65) Prior Publication Data

US 2017/0312563 A1 Nov. 2, 2017

Related U.S. Application Data

(60) Provisional application No. 62/329,968, filed on Apr. 29, 2016.

(51) Int. Cl.
*A63B 5/11* (2006.01)

(52) U.S. Cl.
CPC ..... *A63B 5/11* (2013.01)

(58) Field of Classification Search
CPC .... A63B 5/00; A63B 5/08; A63B 5/10; A63B 5/11; A63B 5/12; A63B 5/16; A63B 6/00; A63B 6/02
See application file for complete search history.

(56) References Cited

U.S. PATENT DOCUMENTS 2,990,203 A * 6/1961 Grover ..... E04G 7/02 182/186.7
3,472,539 A * 10/1969 Fenwick ..... E04B 1/5831 182/224
3,734,496 A * 5/1973 Rubin ..... A63B 5/11 182/139
3,779,201 A * 12/1973 Spahn ..... B63B 1/047 280/206
4,037,835 A * 7/1977 Forsyth ..... A63B 5/11 248/346.5
4,339,123 A * 7/1982 Rich ..... A63B 5/11 403/205
4,726,702 A 2/1988 Jackman
5,385,518 A * 1/1995 Turner ..... A63B 5/11 482/23
5,435,110 A * 7/1995 Stol ..... B62D 23/005 403/170
5,637,057 A * 6/1997 Collura ..... A63B 5/11 482/27
5,810,695 A * 9/1998 Sass ..... A63B 5/11 441/37
6,053,845 A * 4/2000 Publicover ..... A63B 5/11 482/27

(Continued)

*Primary Examiner* — Garrett Atkinson
(74) *Attorney, Agent, or Firm* — Clement Cheng

(57) ABSTRACT

A trampoline has a trampoline frame that includes trampoline frame legs for supporting the trampoline frame, a trampoline bed extended across the trampoline frame for allowing users to rebound on the trampoline bed, a vertical frame member connected to a horizontal frame member, and a trampoline frame joint connecting the vertical frame member to the horizontal frame member. The trampoline frame joint has a joint sleeve formed as a strip. The joint sleeve is fitted to the trampoline frame joint. The horizontal frame member is connected to the trampoline frame joint. The joint sleeve overlies an opening rim edge of the horizontal member. The joint sleeve is welded to the horizontal member and the vertical member is connected to the trampoline frame joint. The vertical member is welded to the horizontal member.

10 Claims, 3 Drawing Sheets

(56) References Cited

U.S. PATENT DOCUMENTS

| | | | | |
|---|---|---|---|---|
| 6,447,426 | B2 * | 9/2002 | Peterson | A63B 5/11 114/311 |
| 6,508,682 | B1 * | 1/2003 | Clark | B63B 7/08 441/131 |
| 6,923,744 | B2 | 8/2005 | Chen | |
| 7,220,218 | B1 * | 5/2007 | Chu | A63B 5/11 403/170 |
| 7,494,444 | B2 | 2/2009 | Adams | |
| 7,789,803 | B2 * | 9/2010 | Plante | A63B 5/11 482/27 |
| 7,833,132 | B2 * | 11/2010 | Hylbert | A63B 5/11 482/27 |
| 8,012,065 | B2 * | 9/2011 | Schaffer | A63B 5/11 403/28 |
| 2003/0064861 | A1 * | 4/2003 | Chen | A63B 5/11 482/27 |
| 2004/0071496 | A1 * | 4/2004 | Chun Yueh | A63B 5/11 403/14 |
| 2004/0091307 | A1 * | 5/2004 | James | F16B 7/04 403/188 |
| 2004/0107491 | A1 * | 6/2004 | Publicover | E04H 4/0018 4/498 |
| 2005/0127346 | A1 | 6/2005 | Steffes | |
| 2009/0181827 | A1 * | 7/2009 | Hylbert | A63B 5/11 482/29 |
| 2009/0260148 | A1 * | 10/2009 | Chen | E04H 4/0025 4/506 |
| 2009/0264042 | A1 * | 10/2009 | Chen | A63G 31/12 446/221 |
| 2010/0035730 | A1 * | 2/2010 | Dukart | A63B 5/11 482/27 |
| 2010/0229296 | A1 * | 9/2010 | Samuel | E04H 4/0025 4/506 |

* cited by examiner

TRAMPOLINE FRAME JOINT

The present application is a non-provisional of U.S. provisional patent application No. 62/329,968 entitled Trampoline Frame Joint by inventor Samuel Chen, filed Apr. 29, 2016, the disclosure of which is incorporated herein by reference.

FIELD OF THE INVENTION

The present invention is in the field of trampoline frames.

DISCUSSION OF RELATED ART

Inventor Samuel Chen in U.S. Pat. No. 6,923,744 discloses a trampoline frame reinforcement method entitled Trampoline System issued Aug. 5, 2005, the disclosure of which is incorporated herein by reference. U.S. Pat. No. 6,923,744 uses a plug weld on a saddle weld reinforcement bracket for increasing rigidity of a saddle weld on a trampoline frame.

In U.S. Pat. No. 3,472,539A, entitled Tubular Frame Joint Member and published Oct. 14, 1969, inventor Fenwick describes a tubular frame joint member of solid steel construction. Its locking horns are adapted to have tubular members inserted within and snapped thereon in locking engagement. The finished joints can be used for different shapes of frame assemblies, the disclosure of which is incorporated herein by reference.

Inventor Rich explains his T-joint connector in U.S. Pat. No. 4,339,123A, entitled T-joint Structure For Trampolines And The Like and published Jul. 13, 1982. The connector has a head-member of circular cross-section that can telescopically receive tube members due to the connector's outer diameter corresponding to the inner diameter of the tube members. The uppermost portion of the connector's leg member is flattened to a size that conforms to interlocking end slots on the ends of the tube members, the disclosure of which is incorporated herein by reference.

U.S. Pat. No. 4,726,702A, entitled Fitting and published Feb. 23, 1988, by inventor Jackman illustrates a fitting for connecting tube members, which comprises of a body, means on the body for accommodating a bonding insert, and means for engaging the fitting with the tube member, whereby on the application of thermal or electrical energy, a bond is formed between the insert and the tube member, the disclosure of which is incorporated herein by reference.

In U.S. Pat. No. 2,990,203A, entitled Extruded Connecting Tees For Scaffolding and published Jun. 27, 1961, inventor Grover introduces a T connector that comprises of a hollow cylindrical portion with at least one extending planar surface portion formed on the outer surface of the cylindrical portion. A pair of prongs project outwardly from said planar surface portion and taper from thicker adjacent said planar surface portion to thinner adjacent the prongs' outer ends. A tube members with at least one rectangular end wedgably circumscribes and is operatively mounted over and about the pair of said prongs, the disclosure of which is incorporated herein by reference.

Inventor Stol describes a method of joining multiple hollow frame members in U.S. Pat. No. 5,435,110A, entitled Method Of Joining Of Hollow Framework And Associated Frame Assembly and published Jul. 25, 1995. In one embodiment of the invention, hollow frame members are secured to central portions of a core member with the core member extending outwardly from the enclosed space. Tabs placed on the core member correspond to notches positioned on an adjacent core member to receive, align, and secure attached frame members, the disclosure of which is incorporated herein by reference.

U.S. patent publication 20050127346A1, entitled Bracket System For Attaching Elongated Members and published Jun. 16, 2005, by inventor Steffes illustrates the use of a U-shaped bracket strip affixed to the surface of a vertical post to receive the end of a rail, being attached to the strip by fasteners. A terminal sleeve extends over the rail and bracket to abut against the post, thus concealing the end of the rail, the disclosure of which is incorporated herein by reference.

In U.S. patent publication 20040071496A1, entitled Pipe Connecting Structure For Trampoline Frame and published Apr. 15, 2004, inventor Yueh describes a pipe connecting structure for trampoline frame consisting of a first pipe, a second pipe, and a coupling bar. The first pipe includes a diameter-reduced portion with diametrically opposite slots on one end. The coupling bar is press-fitted in the diameter-reduced portion of the first pipe and has an axial opening on its outer end in alignment with the aforementioned slots on the first pipe. When the second pipe connects to the diameter-reduced portion of the first pipe, a radially extending fixing pin locates in the two slots of the first pipe and the axial opening of the coupling bar, thus preventing circumferential movement of the two pipes relative to each other, the disclosure of which is incorporated herein by reference.

Inventor James describes a structural coupler in U.S. patent publication 20040091307A1, entitled Structural coupler and published May 13, 2004. The structural coupler is formed from a single piece of metal and connects a cross member support tube and an intersecting support tube without the use of a weld. The cross member support tube forms a rectangular channel and the intersecting support tube forms a circular channel. The structural coupler includes first and second hem couplings in order to secure the configuration of the structural coupler, the disclosure of which is incorporated herein by reference.

U.S. Pat. No. 7,494,444B2, entitled Recreational Structure Using A Sleeve-Joint Coupling and published Feb. 24, 2009, by inventor Adams explains a T configuration sleeve-joint coupling. A first arm member and an aperture are disposed in opposite relationship. A second and third arm member are disposed in opposite relationship. The first arm member receives one end of a vertical frame member and the aperture receives one end of a vertical pole member. The second and third arm members each receive one end of a horizontal frame member of the recreational structure. A tension member applies force pulling the vertical pole member toward the corresponding vertical pole member.

In U.S. Pat. No. 7,220,218B1, entitled Modified Trampoline Holder Structure and published May 22, 2007, by inventor Chu, explains that connection sleeves clamp the joint of two adjacent transverse tubes through the use of locking bumps and grooves, formed at two sides of the inner edge of each tube clamping portion and at two sides of the joint of two adjacent transverse tubes, respectively. When clamped, the bumps and grooves lock together, the disclosure of which is incorporated herein by reference.

SUMMARY OF THE INVENTION

An object of the present invention is to further improve the rigidity of a saddle weld on a trampoline frame, especially for resisting torsional forces.

A trampoline has a trampoline frame that includes trampoline frame legs for supporting the trampoline frame, a trampoline bed extended across the trampoline frame for allowing users to rebound on the trampoline bed, a vertical frame member connected to a horizontal frame member, and a trampoline frame joint connecting the vertical frame member to the horizontal frame member. The trampoline frame joint has a joint sleeve formed as a strip. The joint sleeve is fitted to the trampoline frame joint. The horizontal frame member is connected to the trampoline frame joint. The joint sleeve overlies an opening rim edge of the horizontal member. The joint sleeve is welded to the horizontal member and the vertical member is connected to the trampoline frame joint. The vertical member is welded to the horizontal member.

The trampoline optionally includes a flange brace plate. Flange brace plates can have an upper brace weld connecting the flange brace plate to the horizontal member. The upper brace weld extends to an upper brace weld extension. The upper brace weld extension welds a joint sleeve inside edge of the joint sleeve to the horizontal member. The joint sleeve further includes a joint sleeve upper flat portion and a joint sleeve lower flat portion. The joint sleeve has a joint sleeve inside edge and a joint sleeve outside edge. The joint sleeve outside edge is flush with the horizontal member.

Figure 1:
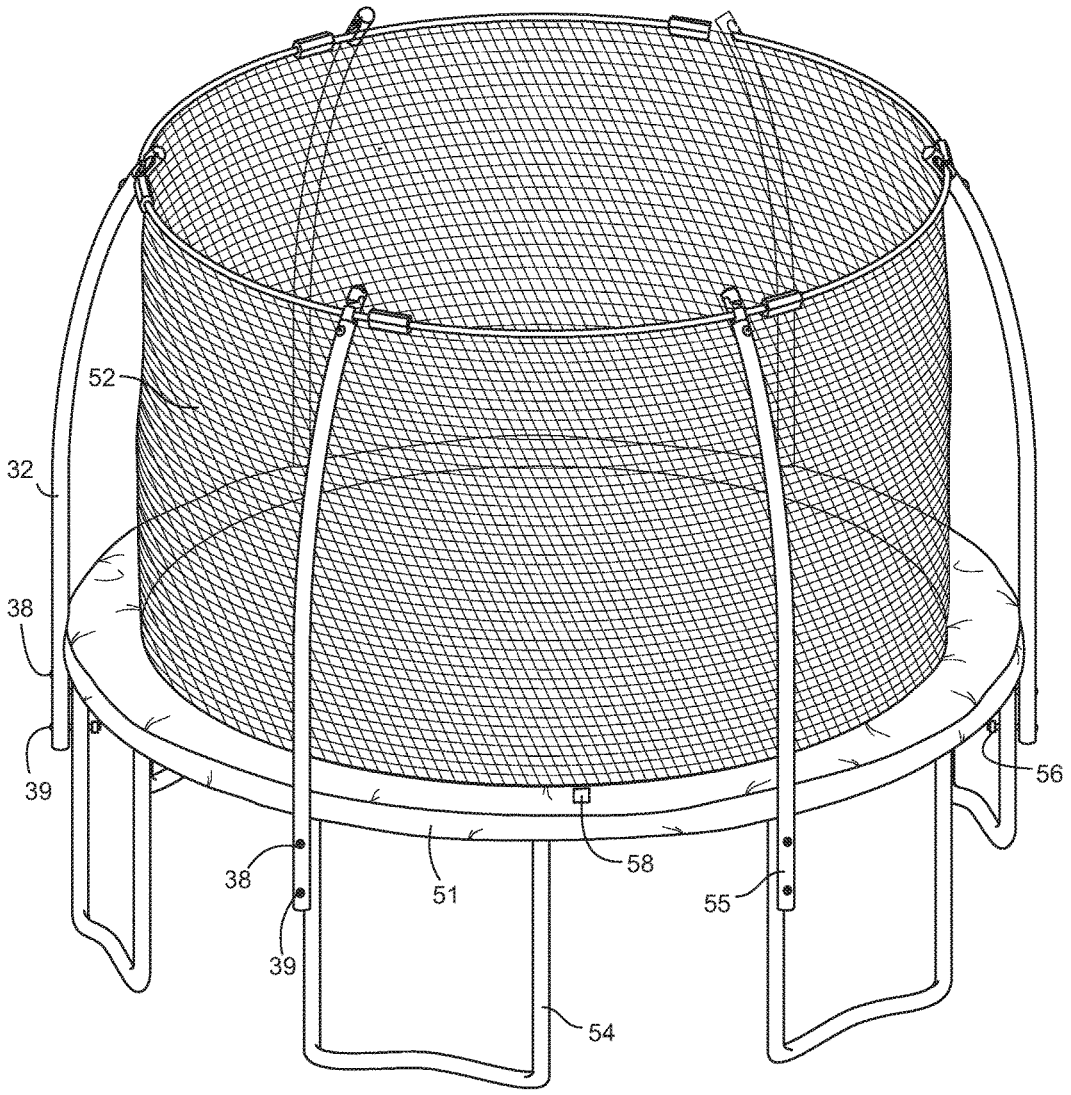
Fig. 1 (Prior Art)
FIG. 1 is a general view of the trampoline and the trampoline frame.
Figure 2:
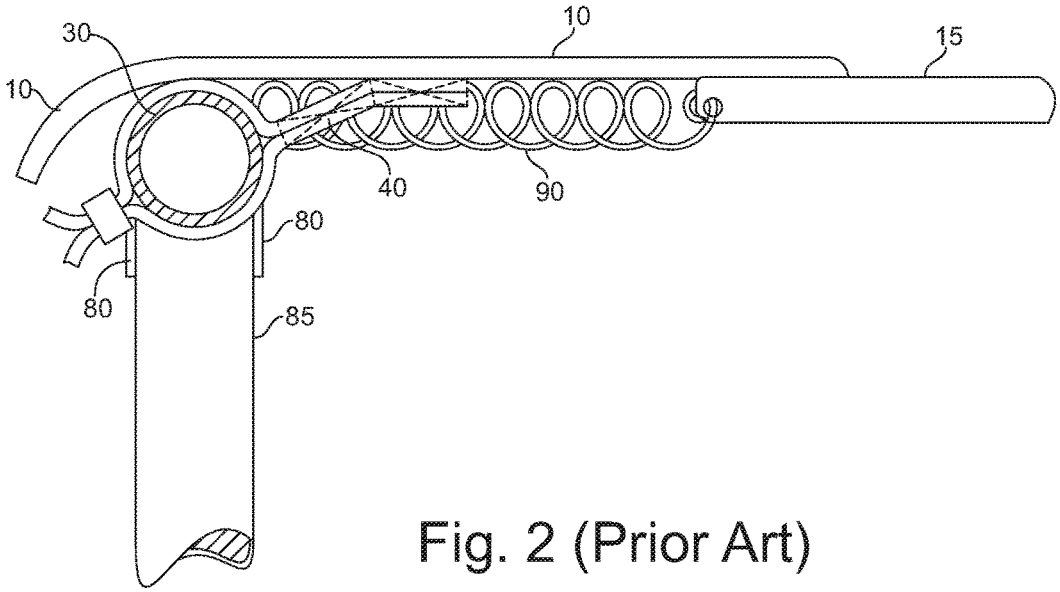
Fig. 2 (Prior Art)
FIG. 2 is a prior art cross-section view of a trampoline frame connection.
Figure 3:
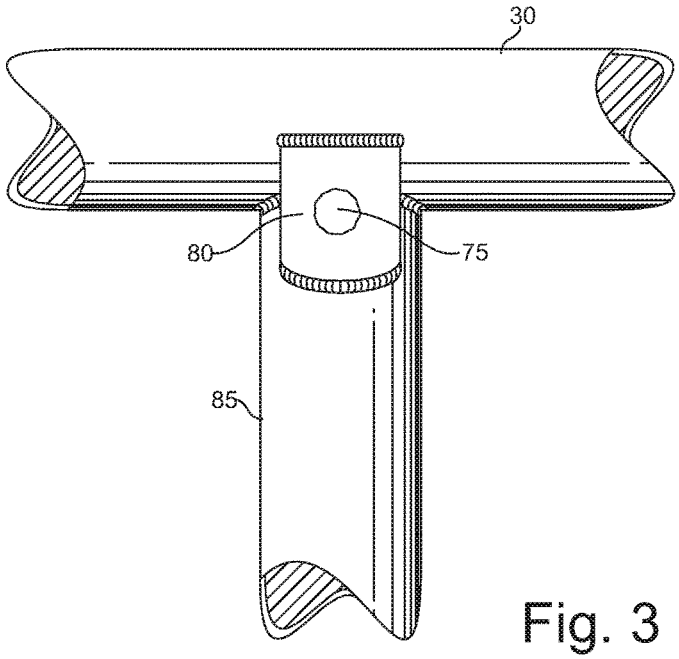
Fig. 3 (Prior Art)
FIG. 3 is a prior art front view of the trampoline frame.

The following call out list of elements can be a useful guide in referencing the element numbers of the drawings.

10 Pad
15 Bed
16 Spring Retaining Opening
21 Horizontal Short End
22 Horizontal Long End
30 Horizontal Members
32 Enclosure Poles
38 First Enclosure Pole Connector
39 Second Enclosure Pole Connector
40 Joint Sleeve
41 Joint Sleeve Upper Flat Portion
42 Joint Sleeve Lower Flat Portion
43 Joint Sleeve Inside Edge
44 Joint Sleeve Outside Edge
45 Joint Opening
51 Trampoline Frame
52 Net
53 Upper Enclosure Support
54 Trampoline Leg
55 Enclosure Pole Connection
56 Enclosure Pole Connection Nut
58 Spring Cover
60 Connection Area
61 Connection Area Hat Upper Portion
62 Connection Area Flat Lower Portion
63 Upper Bowed Ridge
64 Side Bowed Ridge
75 Plug Weld
80 Flange Brace Plate
81 Upper Brace Weld
82 Lower Brace Weld
84 Upper Brace Weld Extension
85 Vertical Members
86 Lower Joint Sleeve Weld
90 Spring

DETAILED DESCRIPTION OF THE PREFERRED EMBODIMENT

A trampoline generally has a trampoline frame 51 having a ring of horizontal members. The trampoline frame 51 is connected to multiple trampoline legs 54. The trampoline legs 54 are U-shaped and connected to the trampoline frame 51 to support the trampoline frame 51 above the ground. The trampoline legs have enclosure poles 32 connected to them. The enclosure poles 32 are connected to the trampoline legs at an enclosure pole connection 55. The enclosure pole connection 55 includes a first enclosure pole connector 38 and a second enclosure pole connector 39 which can be formed of a screw or bolt for example. The enclosure pole connection nut 56 can thread to the enclosure pole connectors when the enclosure pole connectors are formed as bolts. The enclosure poles 32 support an upper enclosure support 53. The upper enclosure support 53 has a net 52 suspended from the upper enclosure support. The net 52 retains users bounding on the trampoline bed. The trampoline bed is connected to the trampoline frame 51 at a plurality of springs that are covered by spring cover 58.

The trampoline frame supports the bed 15, pad 10, springs 90 and user. The trampoline frame is commonly circular when seen from a top plan configuration and made of horizontal tubular members 30, having a number of vertical support legs attached to the horizontal tubular members. The trampoline frame can also be rectangular. The trampoline frame retains a plurality of springs that in turn retain the trampoline surface. The present invention pad 6 rests upon the trampoline frame and springs. The trampoline frame vertical and horizontal members are commonly made of the same material and diameter. The springs engage the spring retaining opening 16.

The trampoline frame is formed of vertical members 85 and horizontal members 30. The vertical 85 and horizontal 30 members travel around the periphery of the trampoline bed 15. Horizontal members 30 are supported by vertical members. The horizontal members 30 connect to vertical members at a T joint connector provided for interconnecting adjacent ends of each top member section. The vertical members support the T joint connectors. Supporting vertical members are generally vertical, but they may be angled also. Here, the term vertical member also includes a member that is substantially vertical. Angled supporting vertical members should be generally vertical with more than a 45 degree angle, but do not have to be 90 degrees to the ground.

The force of a user landing on the trampoline pad puts stress on the trampoline frame. The pad strap gap has an elastic slack space that absorbs some of the stress. The frame absorbs the remainder of the stress. The trampoline frame is reinforced at its T joint connections by a plurality of welding plates acting as flange braces. The flange brace plate 80 is placed on both sides of the T joint connector.

A weld plate 80 is approximately square and formed around the side of the T connector. The plate preferably includes a single hole 75 in the middle of the plate. The plate can be formed of a sheet of metal. The plate can be pressed into a shape conforming to the T connector. The plate has a periphery comprising the top edge, the bottom edge and side edges. The weld plate has a periphery capable of being welded against the T joint connector. The aperture 75 in the plate can be circular. The aperture 75 provides an edge allowing a plug weld 75 between the aperture 75 and the vertical or horizontal frame member.

The weld plate is preferably 2 mm thick before being formed into the profile of the T connector. The weld plate profile is preferably 6 mm thick after being formed into a profile of the T connector. Thus, the plate 80 preferably does not protrude from the T connector member more than 2 mm. The profile of the plate has a straight and flat upper edge with a curved lower edge having a radius proportional to the radius of the vertical member support. The lower curved edge conforms to the vertical member support and the flat upper edge conforms to the horizontal member support. The horizontal and vertical member supports are typically tubular and formed of metal.

Figure 4:
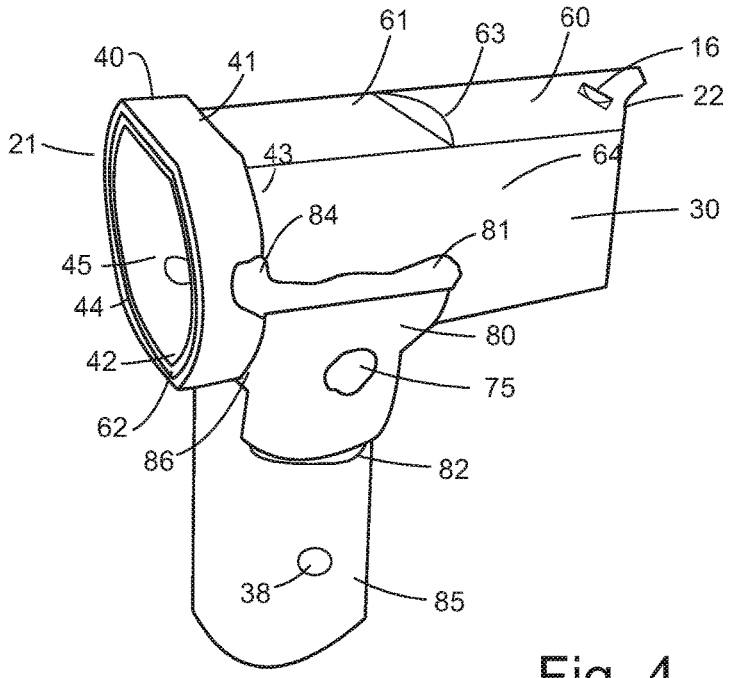
FIG. 4 is a perspective view of the present invention.
Figure 5:
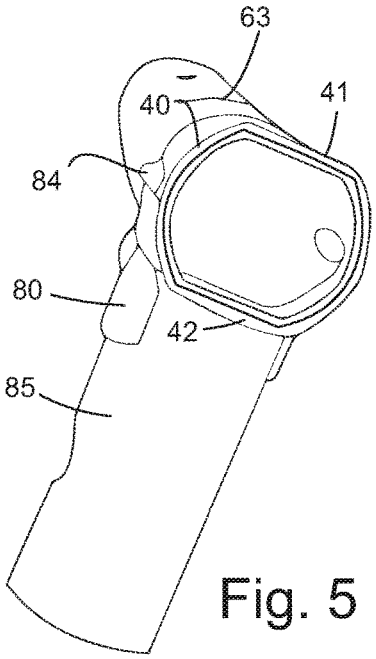
FIG. 5 is a perspective view of the present invention.
Figure 6:
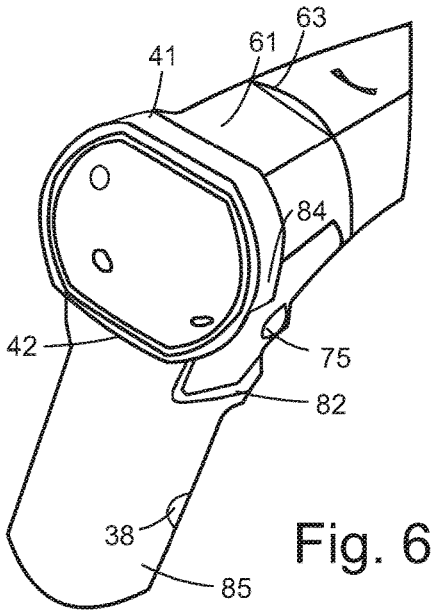
FIG. 6 is a perspective view of the present invention.

The arc weld is preferable to weld the vertical 85 and horizontal members 30. The arc weld between the horizontal and vertical members preferably maintains an intact horizontal member while cutting a section of vertical member and welding the vertical member to the horizontal member. In figure four, the vertical member 85 is shaped to conform to the horizontal member 30. The first weld is between the vertical and horizontal member interface. The second weld is on the plate 80. The plate is shown as a rectangular piece of metal conforming to the external profile of the junction between the horizontal and vertical member. The welding plate 80 preferably receives a top weld along the top edge, and a bottom weld along the bottom edge as shown in FIG. 4. The welding plate should be roughly rectangular. Thus, the plate has a T-junction shape so that it lies flat against the profile of the trampoline frame. Preferably, the plate 80 and junction receive surface treatments such as paint so that the plate 80 is not cosmetically noticeable. A plug weld 75 on the hole 75 increases the connection between the plate and the T-junction. The plug weld 75 overlaps the junction so that the plug weld 75 protrudes through the plate and welds the plate to the junction.

Alternatively, a wire 'mig' welder can be used to form a circumferential weld along the edge of the plate. The plate can be welded in this fashion along the top, bottom, left and right sides. When a mig welder is used for a circumferential weld, the plug weld is optional.

As seen in FIG. 4, four separate pieces of metal are welded together. The four different pieces of metal include the joint sleeve 40, the horizontal member 30, the vertical member 85, and the flange brace plate 80. The joint sleeve 40 has a joint sleeve upper flat portion 41 and a joint sleeve lower flat portion 42. The joint sleeve 40 can be formed of a tubular metal member having a round cross-section. The joint sleeve 40 fits tightly around the rim of the horizontal member 30. The joint sleeve 40 and the horizontal member 30 can start as round and then pressed together to a common shape, or the joint sleeve 40 and the horizontal member 30 can be made independently and then fitted together. The round cross-section of the joint sleeve 40 and the horizontal member 30 can be crimped in a press at an upper surface and a lower surface to form the joint sleeve upper flat portion 41 and the joint sleeve lower flat portion 42. The joint sleeve 40 can be pressed onto the horizontal member 30 at an end of the horizontal member 30. The joint sleeve 40 reinforces the edge of the horizontal member 30. The joint sleeve 40 has a joint sleeve inside edge 43 and a joint sleeve outside edge 44. The joint sleeve can be made from a strip of metal having a thickness. The joint sleeve inside edge 43 and the joint sleeve outside edge 44 are preferably orthogonally oriented relative to the horizontal member 30.

The flange brace plate 80 preferably has a plug weld 75 for welding the flange brace plate 80 to a saddle weld connection portion of the upper end of the vertical member 85. The flange brace plate 80 also preferably has an upper brace weld 81 and a lower brace weld 82. The upper brace weld 81 extends along an upper edge of the flange brace plate 80 and welds the upper edge to the horizontal member 30. The lower brace weld 82 extends along a lower edge of the flange brace plate 80 and welds the lower edge to the vertical member 85.

The upper brace weld extension 84 welds the flange brace plate 80 to the joint sleeve 40 and retains the joint sleeve 40 to the edge of the horizontal member 30. The joint sleeve 40 is laminated to the short edge of the horizontal member 30. The short edge of the horizontal member 30 allows the received end of the received horizontal member to be mounted above the vertical member 85. The joint sleeve 40 is preferably approximately 1 mm in thickness.

A lower joint sleeve weld 86 welds the horizontal member 30 to the joint sleeve 40 at the joint sleeve lower flat portion 42 of the joint sleeve inside edge 43, The lower joint sleeve weld 86 can also weld the flange brace plate 80 to the joint sleeve 40. The joint sleeve 40 is generally mounted at the connection area 60 of the trampoline frame 51. The connection area 60 is generally a socket that has a joint opening 45 for receiving a horizontal frame member. The horizontal frame member should be formed according to the shape of the joint sleeve 40 with a generally round body having an upper and a lower flat portion.

The connection area 60 generally has a connection area flat upper portion 61 and a connection area flat lower portion 62. The interface between the connection area 60 and the circular cross-section area of the remainder of the horizontal member 30 can have a bowed ridge such as an upper bowed ridge 63 and a side bowed ridge 64. The bowed ridge begins at a left side of the connection area flat upper portion 61 and extends to a right side of the connection area flat upper portion 62.

The socket of the horizontal member 30 receives another horizontal member such that both the received horizontal member and the receiving horizontal member are parallel to each other along a circumference of the trampoline frame. The received horizontal member also has an upper flat area portion and a lower flat area portion with rounded sides, namely a rounded left side wall and a rounded right side wall. The horizontal member 30 has a horizontal short end 21 and a horizontal long end 22. The horizontal short end 21 is shorter than the horizontal long end 22 when measured from the connection to the vertical member 85.

The foregoing describes the preferred embodiments of the invention and modifications may be made without departing from the spirit and scope of the invention as set forth in the following claims.

The invention claimed is:

1. A trampoline comprising:

a. a trampoline frame including trampoline frame legs for supporting the trampoline frame;

b. a trampoline bed extended across the trampoline frame for allowing users to rebound on the trampoline bed;

c. a vertical frame member connected to a horizontal frame member; and d. a trampoline frame joint connecting the vertical frame member to the horizontal frame member, wherein the trampoline frame joint comprises:

i. a joint sleeve formed as a strip, wherein the joint sleeve is fitted to the trampoline frame joint;

ii. wherein the horizontal frame member is connected to the trampoline frame joint, wherein the joint sleeve overlies an opening rim edge of the horizontal member, wherein the joint sleeve is welded to the horizontal member; and iii. wherein the vertical member is connected to the trampoline frame joint, wherein the vertical member is welded to the horizontal member.

2. The trampoline of claim 1, further comprising a flange brace plate, wherein the flange brace plate has an upper brace weld connecting the flange brace plate to the horizontal member.

3. The trampoline of claim 2, wherein the upper brace weld extends to an upper brace weld extension, wherein the upper brace weld extension welds a joint sleeve inside edge of the joint sleeve to the horizontal member.

4. The trampoline of claim 1, wherein the joint sleeve further includes a joint sleeve upper flat portion and a joint sleeve lower flat portion.

5. The trampoline of claim 1, wherein the joint sleeve has a joint sleeve inside edge and a joint sleeve outside edge, wherein the joint sleeve outside edge is flush with the horizontal member.

6. The trampoline of claim 1, further comprising a flange brace plate, wherein the flange brace plate has an upper brace weld connecting the flange brace plate to the horizontal member, wherein the upper brace weld extends to an upper brace weld extension, wherein the upper brace weld extension welds a joint sleeve inside edge of the joint sleeve to the horizontal member, wherein the joint sleeve further includes a joint sleeve upper flat portion and a joint sleeve lower flat portion, wherein the joint sleeve has a joint sleeve outside edge, wherein the joint sleeve outside edge is flush with the horizontal member.

7. The trampoline of claim 6, wherein trampoline frame joint has a connection area flat upper portion and a connection area flat lower portion.

8. The trampoline of claim 7, wherein the horizontal member of the trampoline frame joint has an upper bowed ridge formed at an edge of the connection area flat upper portion.

9. The trampoline of claim 1, wherein trampoline frame joint has a connection area flat upper portion and a connection area flat lower portion.

10. The trampoline of claim 9, wherein the horizontal member of the trampoline frame joint has an upper bowed ridge formed at an edge of the connection area flat upper portion.

* * * * *